United States Patent [19]

Kubota et al.

[11] 4,350,876

[45] Sep. 21, 1982

[54] CONTROL CIRCUIT FOR A GLOW PLUG ASSEMBLY SERVING AS AN ENGINE PREHEATING MEANS

[75] Inventors: Yutaka Kubota, Kawagoe; Hitoshi Sugimoto, Higashimatsuyama, both of Japan

[73] Assignee: Diesel Kiki Kabushiki Kaisha, Tokyo, Japan

[21] Appl. No.: 239,433

[22] Filed: Mar. 2, 1981

[30] Foreign Application Priority Data

Mar. 12, 1980 [JP] Japan ..... 55-31048

[51] Int. Cl.[3] ..... H05B 1/02

[52] U.S. Cl. ..... 219/497; 219/202; 219/483; 219/519; 219/494; 123/179 H; 123/179 B; 219/510

[58] Field of Search ..... 219/494, 497, 508–510, 219/483, 514, 519, 493, 202, 203; 123/179 H, 179 B, 179 BG

[56] References Cited

U.S. PATENT DOCUMENTS

| | | | |
|---|---|---|---|
| 3,675,033 | 7/1972 | Richard et al. | 123/179 H |
| 4,075,998 | 2/1978 | Krauss et al. | 123/179 H |
| 4,137,885 | 2/1979 | Van Ostrom | 123/179 H |

FOREIGN PATENT DOCUMENTS

| | | | |
|---|---|---|---|
| 2306372 | 8/1974 | Fed. Rep. of Germany | 219/514 |

*Primary Examiner*—M. H. Paschall

*Attorney, Agent, or Firm*—McAulay, Fields, Fisher, Goldstein & Nissen

[57] ABSTRACT

A control circuit for a glow plug assembly serving as an engine preheating apparatus is designed so as to effect a temperature control in conformity with the specified position established by selective operation of a key switch having three switching positions, i.e., OFF, ON and START positions. The control circuit comprises a first switch connected between the glow plug assembly and a power source, and a series circuit comprising a second switch connected parallel with the first switch and a resistor. The control circuit is capable of effecting three modes of operation: One is that, when the second switch is switched from OFF position to ON position, the first switch is turned on to rapidly effect a preheating of the engine, and is turned off to interrupt the preheating action when the temperature of the glow plug assembly reaches a predetermined value: Second is that, when a key switch is shifted to the START position, the second switch is turned on and the first switch is intermittently turned on to effect a heat retaining operation so that the temperature suitable for starting the engine is maintained; Third is that, when the key switch is switched from START position to ON position, the first switch is turned off while solely the second switch is turned on thereby to maintain the glow plug assembly at a low temperature.

4 Claims, 3 Drawing Figures

CONTROL CIRCUIT FOR A GLOW PLUG ASSEMBLY SERVING AS AN ENGINE PREHEATING MEANS

BACKGROUND OF THE INVENTION

The present invention relates to a control circuit for a glow plug assembly serving as an engine preheating means, and more particularly to a control circuit designed so as to effect a temperature control in conformity with the specified position established by selective operation of a key switch.

Generally, before starting an engine with a starter motor, it is necessary to set a temperature of the glow plug assembly, serving as an engine preheating temperature, to the level suitable for immediate starting thereof, for example, substantially 800° C. In the prior art, power is applied to the glow plug assembly in accordance with the operation of a key switch to heat the glow plug assembly. However, with the method, the following drawback are pointed out; there is a possibility that the temperature of the glow plug assembly may excessively increase or decreases. As a result, the durability of the glow plug assembly is reduced or the engine cannot be started for a short interval.

Reference is made to the another aspect of the preheating method. For instance, in the event that the temperature of the engine is relatively high, the engine can be started by preheating the glow plug assembly simultaneously with placing the key switch to the START position. However, in the prior art, the glow plug assembly is designed so as to be preheated solely in accordance with the operation of the key switch to the ON position. Therefore, the prior art device is not favorable in terms of power consumption.

SUMMARY OF THE INVENTION

A primary object of the present invention is to provide a control circuit for a glow plug assembly serving as an engine preheating means capable of setting a temperature of a glow plug assembly to an adequate value, when a key switch is placed in condition for ON position or START position, to start the engine in a stabilized manner.

A second object of the invention is to provide a control circuit for a glow plug assembly serving as an engine preheating means which makes it possible to minimize an undesirable heating of the glow plug assembly to increase the durability.

A third object of the invention is to provide a control circuit for a glow plug assembly serving as an engine preheating means which makes it possible to minimize power consumption by interrupting a power to the glow plug if the glow plugs need not be heated, such as, if the engine is already in a heated condition.

BRIEF DESCRIPTION OF THE DRAWINGS

Further objects, features and advantages of the present invention will become apparent from the following detailed description in conjunction with the accompanying drawings, wherein.

DETAILED DESCRIPTION OF THE PREFERRED EMBODIMENTS

Figure 1:
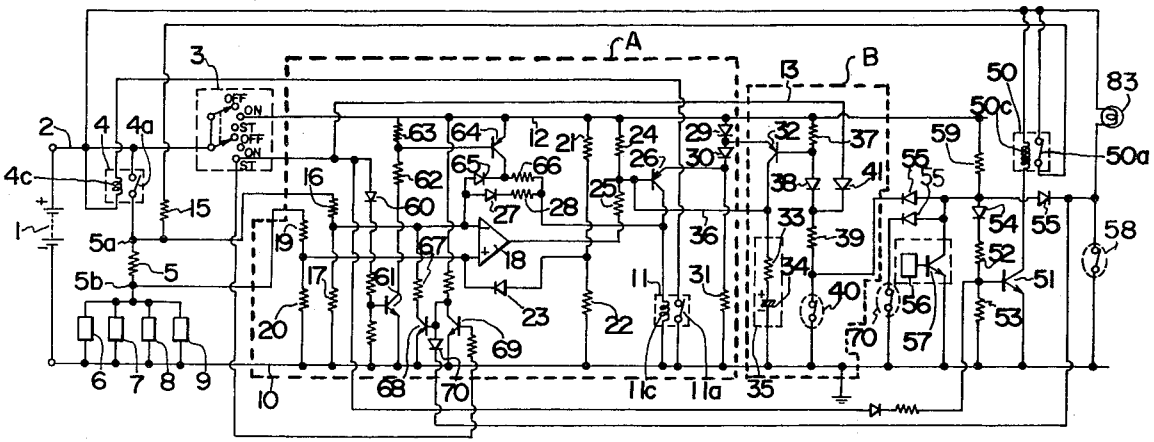
FIG. 1 is a circuit diagram showing a preferred embodiment of a control circuit for a glow plug assembly in accordance with the present invention.

Referring now to FIG. 1, a conductor 2, which is connected to the positive (+) terminal of a battery 1, is connected to one end of a key switch 3, to one end of a normally open contact 4*a* and a relay winding 4*c* constituting a relay switch 4. The normally open contact 4*a* has the other end connected through a resistor 5 to the terminal of glow plugs assembly consisting of a plurality of glow plugs 6, 7, 8 and 9 respectively provided on combustion chambers of the engine, the glow plugs 6 to 9 each having the other terminal connected to an earth wire 10, which is connected to the negative (−) terminal of the battery 1. The relay winding 4*c* has the other end connected through a relay switch 11 consisting of a relay winding 11*c* and a normally open contact 11*a* to the earth wire 10. The key switch 3 has three switching positions, i.e., OFF, ON and ST positions wherein a movable contact is changeable therebetween. A common conductor 12 is connected to an ON contact and a ST contact with a conductor 13 connected to another ST contact.

Reference character A denotes a temperature detecting circuit. Resistors 16 and 17 are interposed in series between one end 5*a* of the resistor 5 and the earth wire 10, with a junction between the resistors 16 and 17 connected to an inverting input terminal of a comparator 18. The comparator 18 serves as a first switching control circuit for controlling the contact 4*a* in accordance with the temperature of the glow plug assembly. Resistors 19 and 20 are interposed in series between the other end 5*b* of the resistor 5 and the earth wire 10, with a junction between the resistors 19 and 20 connected to a non-inverting input terminal of the comparator 18. Resistors 21 and 22 are interposed in series between the conductor 12 and the earth wire 10, with a junction between the resistors 21 and 22 connected through a diode 23 to the non-inverting input terminal of the comparator 18.

Further, resistors 24 and 25 are interposed in series between the conductor 12 and an output terminal of the comparator 18, with a junction between the resistors 24 and 25 connected to a base electrode of a transistor 26. The transistor 26 has a collector electrode connected to the earth wire 10 through a relay winding 11*c* of the relay switch 11. The comparator 18 has the inverting input terminal connected to a junction between the collector electrode of the transistor 26 and the relay winding 11*c* through a diode 27 and a resistor 28 connected in series. Further, diodes 29 and 30 and a resistor 31 are interposed in series between the conductor 12 and the earth wire 10, with a junction between the diode 30 and the resistor 31 connected to an emitter electrode of the transistor 26.

A junction between the diodes 29 and 30 is connected to an emitter electrode of a transistor 32, a collector electrode which is connected to the earth wire 10 through a trigger circuit 35 comprising a resistor 33 and a capacitor 34 connected in series. Then, the base electrode of the transistor 26, and a junction between the collector electrode of the transistor 32 and the trigger circuit 35 are placed in short circuit by a conductor 36.

Further, a resistor 37, a diode 38, a resistor 39 and a water temperature switch 40 are interposed in series between the conductor 12 and the earth wire 10, with a junction between the resistor 37 and the diode 38 connected to the base electrode of the transistor 32. The water temperature switch 40 is turned on when a temperature of cooling water for the engine is above a predetermined level. A conductor, which is connected to the ST contact of the key switch 3, is connected to a junction between the diode 38 and the resistor 39 through the diode 41. Reference character B designates a power interrupting circuit.

One end of a resistor 15 is connected to the junction 5*a*. The resistor 15 is connected to a power source 1 through a contact 50*a* of a relay 50, the relay 50 being connected to a transistor 51 of which the base electrode is connected to the ST contact, the transistor 51 having its base electrode connected to a junction between resistors 52 and 53. The resistor 52 is connected to the ON contact of the key switch through a resistor 59 and a diode 54. This transistor serves as a second switching control circuit for controllng the contact 50*a* connected in series to the resistor 15. A gear switch 70, a water temperature switch 40 and a regulator switch 58 are connected to a junction between a resistor 59 and a diode 54 through a diode 55, respectively, and a transistor 57 is directly connected thereto. The timer 56 becomes operative when the key switch 3 is shifted from the ST position to the ON position.

The ST contact of the key switch 3 is connected to the base electrode of a transistor 61 through a diode 60. The resistors 62 and 63 are connected to the collector electrode of the transistor 61. The collector electrode of a transistor 64 is connected to a junction between a diode 65 and a resistor 66, and the base electrode thereof is connected to a junction between the resistors 62 and 63. Assuming that the transistor 64 is turned on, the resistor 66 is substantially disregarded. Thus, the operating level of the comparator 18 is determined so that the lower limit of the temperature of the glow plug assembly is set to approximately 800° C. The inverting input terminal of the comparator 18 is connected to the collector electrode of a transistor 68 through a resistor 67. The base electrode of the transistor 68 is connected to the collector electrode of the transistor 69 and is connected to the regulator switch 58 through a diode 70.

The transistor 69 has its base electrode connected to the ST contact. It is here noted that the aforementioned resistors 28, 66 and 67 are used for setting an electrical potential appearing at the inverting input terminal of the comparator 18 to a predetermined level. For instance, if the transistor 64 is turned on, the diode 65 is placed in cut-off condition with the result that the resistor 66 is substantially disregarded as a circuitry component. In this instance, solely the resistor 28 is available, whereby a reference voltage appearing at the inverting input terminal of the comparator 18 rises. On the contrary, in the event that the transistor 64 is turned off, a reference voltage appearing at the inverting input terminal thereof.

Figure 2:
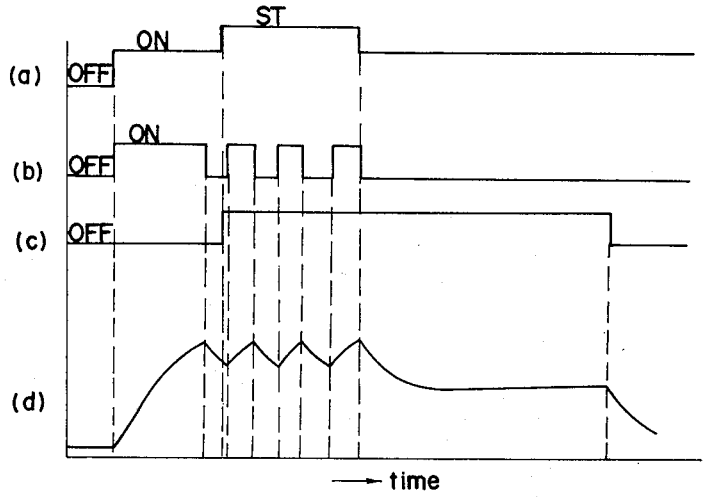
FIG. 2 is timing charts of parts in the control circuit shown in FIG. 1 and a graph illustrating a temperature characteristic of glow plug assembly shown in FIG. 1 wherein FIG. 2(*a*) is a waveform illustrating an operational mode of a key switch, FIG. 2(*b*) is a waveform illustrating an operational mode of a relay switch responding to the action of the key switch, FIG. 2 (*c*) is a waveform illustrating an operational mode of a relay switch responding to the action of the key switch, and FIG. 2 (*d*) is a graph illustrating a temperature characteristic of glow plug assembly corresponding to the key switch.

The operation of the control circuit for a glow plug assembly as constructed above will be described with reference to FIG. 2(*a*) to (*d*) showing the operational characteristics and temperature characteristics. In the event that the engine is placed in a low temperature condition (when the water temperature switch 40 is set to the OFF position). In this condition, if the key switch 3 is set to the ON position, an electric current flows into the capacitor 34 of the trigger circuit 35 through the resistors 24 and 33 with the result that the capacitor 34 is charged. As a result, the transistor 26 is turned on so that the relay winding 11*c* of the relay switch 11 is energized thereby to close the contact 11*a*. For this reason, the relay winding 4*c* of the relay switch 4 is also energized thereby to close the switch 4*a* so that battery voltage is applied to the glow plugs 6 to 9 through the resistor 5 having a small coefficient of resistance per unit of temperature.

A heating element constituting each glow plugs 6 to 9 comprises a resistance element having a large positive coefficient of resistance per unit of temperature, such as for example, Ni where its resistance value is approximately 0.1Ω at a room temperature. Since in addition to the heating element, the resistor 5 also has a small resistance value, approximately 0.007Ω, glow plugs 6 to 9 are rapidly heated. Accordingly, the resistance value of the heating element also increases as the glow plugs are heated. As a result, an electric potential at a point indicated by reference numeral 5*b* increases. As a result, the resistance value of the heating element reaches the specified resistance value obtained when the surface temperature of the glow plugs 6 to 9 reaches approximately 800° C. Each resistance value of the resistors 16, 17, 19 and 20 is selected so that, when the above mentioned condition is established in the heating element, the output state of the comparator serving as the first switch control circuit is shifted from L level to H level. When the comparator 18 is shifted to the H level, the transistor 26 is forcibly turned off by the output of the comparator 18. As a result, the contact 11*a* is opened with the result that the contact 4*a* is also opened to deenergize the glow plugs 6 to 9. Thus, the heating of the glow plugs is interrupted, thereby preventing the glow plugs being subject to the overheated condition. For this reason, the glow plugs are prevented from being broken.

Next, when it is known by a preheating indicating lamp not shown that the preheating has been established, and accordingly the key switch 3 is then switched to the ST position, the starter motor not shown is driven and at the same time the transistor 51 serving as the second control circuit is turned on whereby the relay winding 50*c* is energized to close the contact 50*a* of the relay switch 50. Thus, low voltage is applied from the power source to the glow plugs 6 to 9 through the contact 50*a*, the voltage dropping resistor 15 and resistor 5. As a result, the heating temperature of the glow plugs 6 to 9 is lowered. If the temperature of the glow plug assembly lowers to a predetermined low temperature, for instance, about 800° C. whereby an electric potential of the junction 5*b* is lowered, the output of the comparator 18 is shifted to the L level. As a result, the contact 11*a* is closed and the contact 4*a* is for the second time closed whereby the heating temperature of the glow plugs 6 to 9 raises.

When the heating temperature raises to reach a predetermined low temperature, for instance, approximately 900° C., the output state of the comparator 18 is shifted to the H level. As a result, the contact 4*a* of the relay switch 4 is for the second time closed whereby power is fed to the glow plugs 6 to 9 through the resistor 5, thus raising the heating temperature. That is, when power is supplied to the glow plugs 6 to 9 through the contact 50*a*, the resistor 15 and the resistor 5, the temperature thereof lowers. However, when the temperature lowers to a predetermined level, the contact 4*a* of the switch 4 is closed, power is supplied to glow plugs 6 to 9 directly through resistor 5 and thus the temperature elevates. When the temperature increases to a predetermined level, the contact 4*a* of the switch 4 is opened. As a result, power is supplied to the glow plugs 6 to 9 through the contact 50*a* of the switch 50, the resistor 15 and the resistor 5. Such operation is repeated whereby the temperature of the glow plug assembly varies in a high temperature region suitable for starting the engine to effect a heat retaining action. Accordingly, in such a heat retained condition, it is possible to securely start the engine. In this case, the transistor 61 is placed in an on condition by a suitable voltage applied through the diode 60 and accordingly, the transistor 64 is placed in an on condition. For this reason, the diode 65 is placed in cut-off condition and accordingly, the resistor 66 is substantially disregarded. At this time, the transistor 68 is placed in an off condition and accordingly, the resistor 67 is disregarded. Such a condition assures that the lower limit temperature of the glow plug assembly is maintained at 800° C. when the output state of the comparator 18 is shifted to L level while the higher limit temperature thereof is maintained at 900° C. when the output state of the comparator 18 is shifted to H level.

Next, when the key switch 3 is switched from the ST contact to the ON contact, the transistor 64 is turned off so that the diode 65 is put into conductive condition. Accordingly, resistor 66 is substantially available as a circuitry component of the comparator 18. Further, when the transistor 68 is turned on, the resistor 67 is substantially available as a circuitary component of the comparator 18 thereby lowering the reference voltage appearing at the inverting input terminal of the comparator 18. Thus, the output of the operating level of the comparator 18 is altered. Therefore, due to the fact that the resistor 15 is connected to the glow plugs 6 to 9, the input voltage applied to the glow plugs 6 to 9 is reduced. The applied voltage is lower than that of the junction 5*b* appearing at the time when the temperature thereof lowers to its lowest level. As a result, the output of the comparator 18 becomes saturated, so that the contact 4*a* of the relay switch 4 is always maintained opened. On the other hand, the conductive state of the transistor 51 is maintained due to the potential appearing at the junction between the resistors 52 and 53, and accordingly solely an electric current through the resistors 15 and 5 is supplied to the glow plugs 6 to 9 so that the temperature of the glow plugs 6 to 9 is maintained at a constant temperature, for example, at a low temperature such as, 650° C. Thus, it is possible to warm the engine at the aforesaid low temperature to effect smoothly warming up operation thereof. In addition, even if the engine fails to start, shifting the key switch to the START position makes it possible to rapidly raise the glow plug temperature to a level of, for example, approximately 800° to 900° C., suitable for starting the engine thereby enabling to re-start the engine. It is here noted that the base electrode of the transistor 51 is zero clamped to be turned off if the following conditions are established: One is that, the temperature switch 40 is turned on when the temperature of water for cooling the engine is above a fixed level; Second is that, the gear switch 70 is turned on when the gear is engaged for vehicle running; Third is that, the regulator switch is turned on. When any one of the above mentioned conditions is established, power fed to the glow plugs 6 to 9 is interrupted thereby lowering the temperature thereof.

The transistor 51 is turned off, after sufficient time passes with respect to the time when the shift operation from the ST contact to the ON contact of the key switch 3 is established, by the output of the timer which becomes operative responsive to the above shift operation of the key switch 3.

Figure 3:
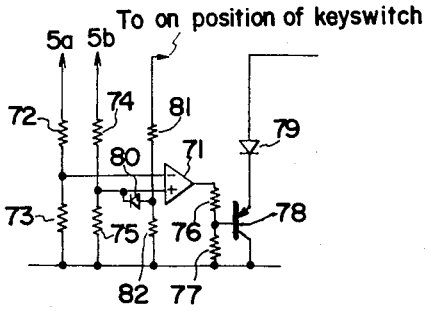
FIG. 3 is an electric circuit showing another embodiment of the control circuit shown in FIG. 1.

FIG. 3 is a circuit diagram showing another embodiment of a control circuit for glow plug assembly in accordance with the present invention, particularly showing principal part thereof. In the circuit diagram, reference numeral 71 designates a comparator for detecting an abnormal temperature, wherein the inverting input terminal thereof is connected to a junction between resistors 72 and 73 while the non-inverting input terminal thereof is connected to a junction between resistors 74 and 75 and to the cathode electrode of a diode 80, and the output thereof is connected to a series circuit comprising resistors 76 and 77. The resistor 72 is connected to the junction 5*a* shown in FIG. 1, the resistor 74 is connected to the junction 5*b* shown in FIG. 1, and a junction between the resistors 76 and 77 is connected to the base electrode of a transistor 78 having the collector electrode connected to a junction between the diode 54 and the resistor 59 through the diode 79. A junction between resistors 81 and 82 is connected to the anode electrode of the diode 80, the resistor 81 having the other end connected to the ON contact of the key switch 3.

According to the abovementioned construction, when the temperature of the glow plugs 6 to 9 reaches an abnormal level, for example, in excess of 1,000° C., the potential appearing at the non-inverting input terminal of the comparator 71 becomes greater than a reference potential appearing at the inverting input terminal thereof, the output thereof becomes H level. Accordingly, the transistor 78 is turned on and the transistor 51 is turned off so that power fed to the glow plugs 6 to 9 is interrupted to lower the temperature, thus making it possible to improve the durability of the glow plugs 6 to 9.

What is claimed is:

1. A control circuit in an engine for controlling the heating of at least one glow plug, comprising:

means for producing a temperature signal responsive to a temperature coefficient of resistance in said glow plug;

a key switch having at least an OFF position, an ON position and a START position;

first switch means responsive to placing said key switch in said ON position for applying a first voltage to said at least one glow plug whereby said glow plug is heated;

said first switch means being responsive to said temperature signal for interrupting said power to said glow plug when said temperature signal indicates a glow plug temperature exceeding a first temperature value, whereby said glow plug is preheated to said first temperature value;

second switch means responsive to placing said key switch in said START position for applying a second voltage lower than said first voltage to said at least one glow plug; and said first switch means being effective, when said key switch is placed in said START position for applying said first voltage to said glow plug until said temperature signal indicates a glow plug temperature exceeding a second temperature and applying said second voltage until said temperature signal indicates a glow plug temperature less than a third temperature lower than said second temperature and then further effective for reapplying said first voltage whereby said glow plug temperature alternates between said second and said third temperatures.

2. A control circuit according to claim 1, further comprising means responsive to transition of said key switch from said START to said ON position for maintaining application of said second voltage to said glow plug whereby said glow plug remains heated to a fourth temperature lower than said third temperature to permit rapid reheating to a temperature between said second and third temperatures when said key switch is again placed in said START position.

3. A control circuit according to claim 2, further comprising means for removing said second voltage from said glow plug in response to at least one of a water temperature exceeding a predetermined value, a gear engagement, and a regulator switch closure.

4. A control circuit according to claim 2, further comprising means for removing said second voltage a predetermined time after said transition of said key switch from said START to said ON position.

* * * * *